United States Patent [19]

Poock et al.

[11] Patent Number: 4,557,391

[45] Date of Patent: Dec. 10, 1985

[54] METHOD OF CONTROLLING THE ANGLE OF A PIVOTAL BOOM WITH EXTENSIBLE SECTIONS

[75] Inventors: Darwin N. Poock, Cedar Rapids; Robert A. Rathe, Hiawatha, both of Iowa

[73] Assignee: FMC Corporation, Chicago, Ill.

[21] Appl. No.: 648,110

[22] Filed: Oct. 25, 1984

Related U.S. Application Data

[62] Division of Ser. No. 393,986, Jun. 30, 1982.

[51] Int. Cl.[4] ..... B66C 23/82; B66C 23/42

[52] U.S. Cl. ..... 212/270; 212/262; 212/182; 212/186; 212/264; 212/256

[58] Field of Search ..... 212/181, 153, 195, 222, 212/255, 230–232, 264, 266–268

[56] References Cited

U.S. PATENT DOCUMENTS

| | | | |
|---|---|---|---|
| 1,077,467 | 1/1913 | Gardner | 212/262 |
| 2,529,454 | 11/1950 | Marcantonio | 212/188 |
| 2,572,336 | 10/1951 | Hall | 212/262 |
| 2,868,392 | 1/1959 | Poffenberger | 212/8 |
| 2,999,600 | 9/1961 | Gates | 212/55 |
| 3,083,837 | 4/1963 | Jones et al. | 212/183 |
| 3,306,470 | 2/1967 | Green et al. | 212/188 |
| 3,308,967 | 3/1967 | Barkley et al. | 212/55 |
| 3,371,799 | 3/1968 | Brownell et al. | 212/35 |
| 3,674,157 | 7/1972 | Fikse | 212/267 |
| 3,727,359 | 4/1978 | Vonck | 52/121 |
| 3,856,151 | 12/1974 | Lamer | 212/55 |
| 3,987,594 | 10/1976 | Rao et al. | 212/267 |
| 4,053,058 | 10/1977 | Jensen et al. | 212/8 |
| 4,133,411 | 1/1979 | Curb | 182/2 |
| 4,156,331 | 5/1979 | Lester et al. | 52/115 |
| 4,352,434 | 10/1982 | Poock | 212/186 |

FOREIGN PATENT DOCUMENTS

| | | | |
|---|---|---|---|
| 749793 | 7/1980 | U.S.S.R. | 212/262 |

*Primary Examiner*—Trygve M. Blix
*Assistant Examiner*—R. B. Johnson
*Attorney, Agent, or Firm*—A. J. Moore; H. M. Stanley; R. B. Megley

[57] ABSTRACT

A method and apparatus is disclosed for controlling the angle of a pivoted, pendant supported extensible boom and the mast-boom angle between working positions and a transport position. The structure for controlling the angle includes a wire rope driven by a winch and trained over a boom supporting hoist and over a pendant take-up hoist which includes a floating sheave assembly connected to an extensible portion of the boom by a fixed length pendant. Another fixed length pendant determines the mast-boom angle when the boom is in working position, and a floating sheave stop is pivoted to the mast in position to cradle and/or abut a portion of the floating sheave assembly for enabling complete control of the mast when moved between its transport position and working positions relative to the boom.

8 Claims, 6 Drawing Figures

FIG_1
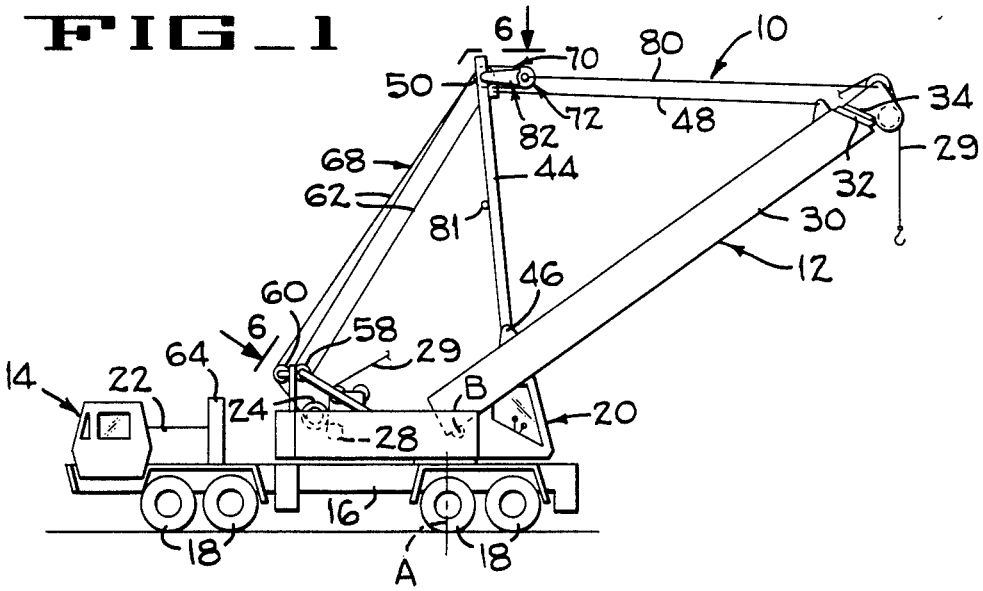
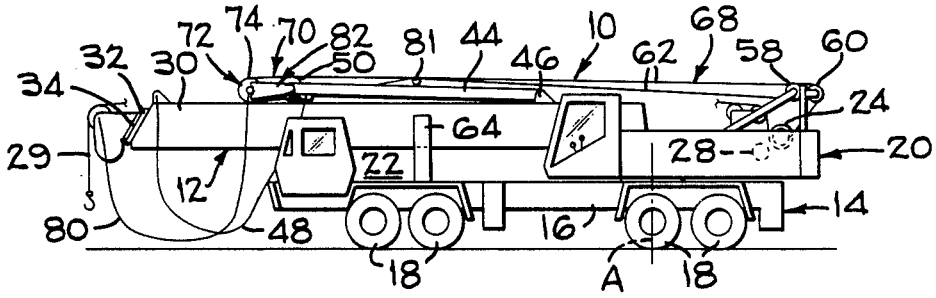
FIG_2
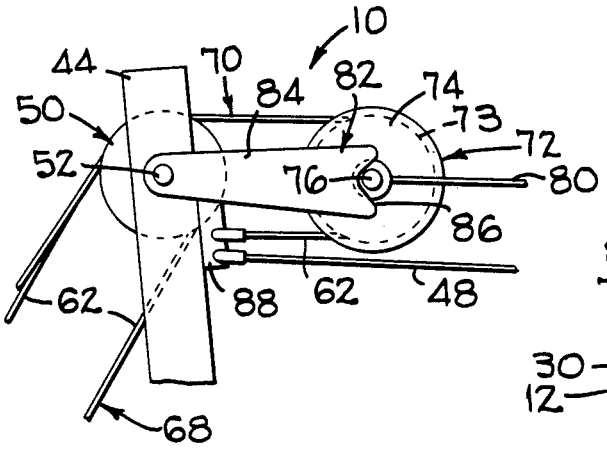
FIG_3
FIG_4
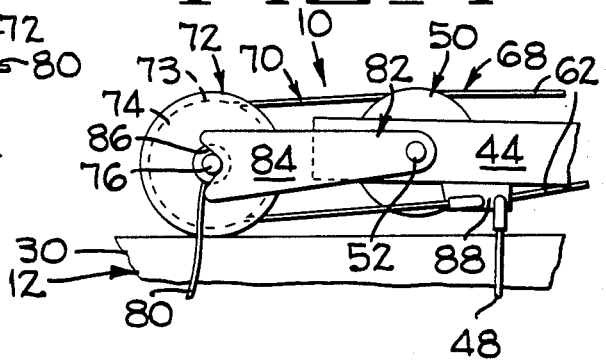

METHOD OF CONTROLLING THE ANGLE OF A PIVOTAL BOOM WITH EXTENSIBLE SECTIONS

This application is a division of application Ser. No. 393,986, filed 6/30/82.

CROSS REFERENCE TO RELATED APPLICATIONS

The present invention is similar to the inventions disclosed in the following copending applications assigned to the assignee of the present invention:

Poock U.S. application Ser. No. 145,529 which was filed on May 1, 1980 entitled Pendant Supported Hydraulic Extensible Boom now U.S. Pat. No. 4,352,434 which issued on Oct. 5, 1982.

Cozad U.S. application Ser. No. 293,727 which was filed on Aug. 17, 1981 and is entitled Low Droop Multi-Part Pendant Supported Boom.

Scherman application now U.S. Pat. No. 4,460,098 which issued on July 17, 1984 and is entitled Pendant Control System For Pendant Supported Boom, and filed on even date herewith.

Poock U.S. application Ser. No. 393,985 entitled External Pendant Pay-Out System With Anti-Droop Control, and filed on even date herewith now U.S. Pat. No. 4,492,312 which issued on Jan. 8, 1985.

White U.S. application Ser. No. 393,983 entitled Pendant Supported Boom With Fixed And Live Pendant Portions, and filed on even date herewith, now U.S. Pat. No. 4,467,928 which issued on Aug. 28, 1984.

BACKGROUND OF THE INVENTION

1. Field of the Invention

The present invention relates to multi-section pendant supported telescopic booms and more particularly relates to a pendant pay-out system for preventing uncontrollable falling of the live mast when being lowered and for preventing raising of the boom before the desired angle between the boom and the mast is obtained.

2. Description of the Prior Art

Multi-section, pendant supported telescopic booms for cranes or the like are well known in the art. It is also well known that such booms may be supported by pendant ropes that are located entirely externally of the boom, or may be of the type that have external pendant portions as well as internal pendant portions that are reeved around sheaves within the boom. Booms of the type having only external pendant ropes that are attached to, or near, the tip end of the boom and are trained over the upper end of a mast pivoted to the boom tend to raise the boom and decrease the angle between the mast and the boom in response to extension of the boom; and tend to lower the boom tip and to increase the angle in response to retraction of the multi-section boom.

The types of booms which are supported by pendants having both internal and external pendant portions, such as the boom disposed in the aforementioned Cozad application, operate in a reverse manner, i.e., the tip drops when extended and raises when retracted.

It is also well known in the art to extend and retract several sections of a multi-section boom with one or two hydraulic rams. U.S. Pat. No. 4,156,331, which issued to Lester et al on May 29, 1979 illustrates such a boom which uses two rams; and U.S. Pat. No. 4,133,411 which issued to Curb on Jan. 9, 1979 illustrates a boom operated by a single ram.

SUMMARY OF THE INVENTION

In accordance with the present invention a pivotally mounted telescopic boom having a live mast pivoted thereon is raised and lowered by a single winch having a wire rope trained therearound and around a multi-sheaved grooved boom hoist between multiple sheaves located adjacent the pivoted end of the boom and the top of the mast, and a multiple sheaved pendant take-up hoist of different mechanical advantage ratio between the multiple sheaves on the mast and a multiple floating sheave. A first fixed length pendant rope is connected between the mast and the base section of the boom to establish a fixed mast-boom working angle, and a second fixed length pendant portion is connected between the floating sheave and the other end of the boom. A floating sheave stop is pivoted to the upper end of the mast and cradles the floating sheave when the boom is fully retracted for maintaining control of the sheave and mast when moving the mast between its raised working position and its lowered transport position.

BRIEF DESCRIPTION OF THE DRAWINGS

FIG. 1 is a diagrammatic side elevation of a crane with its boom shown retracted but in an elevated working position.

FIG. 2 is a side elevation of the crane of FIG. 1 but with the boom and mast lowered into transport position.

FIG. 3 is an enlarged side elevation of the upper end of the mast when positioned as shown in FIG. 1 illustrating the position of the floating sheave relative to the floating sheave stop when the boom is fully retracted but is being supported in elevated position.

FIG. 4 is an enlarged side elevation similar to FIG. 3 but taken when the mast and boom are in transport position.

DESCRIPTION OF THE PREFERRED EMBODIMENT

Figure 5:
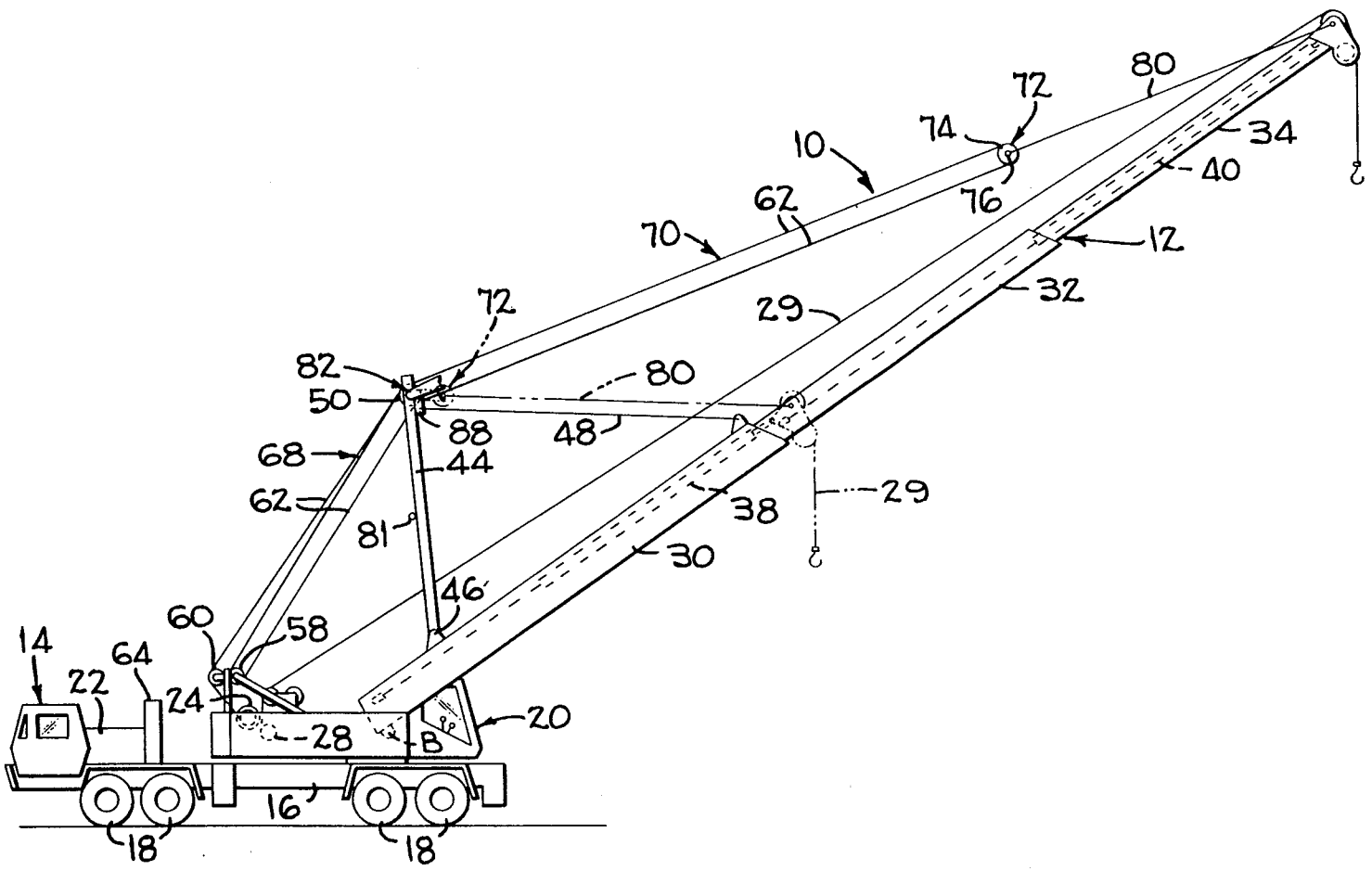
FIG. 5 is a diagrammatic side elevation of the boom illustrated in solid lines an extended and elevated position and in phantom lines in a retracted and elevated position.

The pendant pay-out system 10 (FIGS. 1 and 6) of the present invention is illustrated in conjunction with a multi-section extensible boom 12 of a mobile crane 14. The crane 14 (FIGS. 1 and 2) includes a chassis 16 supported on wheels 18 with an upper works or frame 20 mounted for rotation on the chassis 16 about a vertical axis A. The crane includes an engine 22 which provides power for driving at least some of the wheels 18, for rotating the upper works 20, and for driving hydraulic pumps and motors which provide power for several winches including a boom supporting and pendant take-up winch 24, and a load line winch 28. The load line winch is provided to raise and lower a load supported by a load line 29 (only a fragment being shown in FIG. 1) trained over the outer end of the boom.

The boom 12 is diagrammatically illustrated as a three section boom that is supported by the pendant pay-out system 10, which boom includes a base section 30 pivoted to the upper works 20 about a horizontal axis B, an intermediate section 32, and a tip section 34. The three boom sections are telescopically received within each other in a manner conventional in the art. Also, the boom sections may be extended and retracted in a manner conventional in the art. For example, a first hydraulic cylinder 38 (FIG. 5) connected between the base section 30 and the intermediate section 32 and a second hydraulic cylinder 40 connected between the intermediate section 32 and the tip section 34 may be used for extending and retracting the boom sections under the control of the operator. Although a three section boom is illustrated it will be understood that the invention covers a four section boom as well.

A mast 44 is pivoted at 46 to the base section 30 near the inner end of said base section. At least one fixed length pendant line 48 is connected between the upper end of the mast 44 and the outer end of the base section 30. The fixed length pendant 48 is provided to maintain the desired mast-boom working angle when the boom is elevated to a working position such as illustrated in FIG. 1. Multiple sheave unit 50 (FIGS. 3, 4 and 6) is journaled on a shaft 52 secured to the upper end of the live mast.

Figure 6:
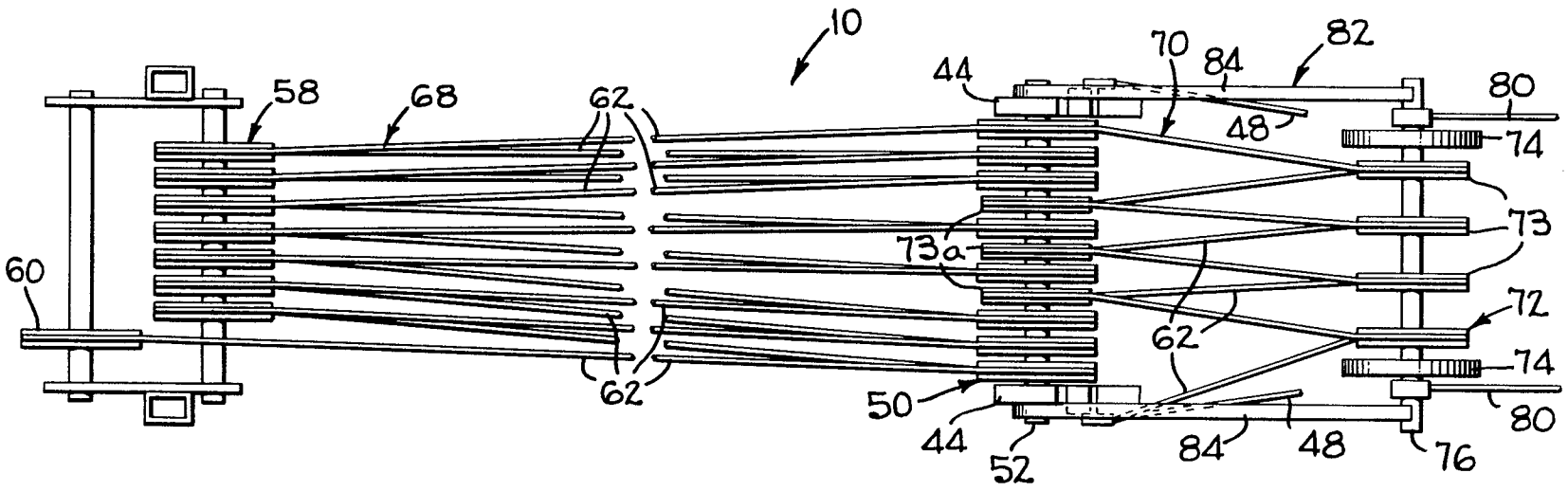
FIG. 6 is an enlarged diagrammatic view of the multiple boom hoist and multiple pendant take-up hoist looking in the direction of the arrows 6—6 of FIG. 1, certain parts of the mast being cut away and the width being exagerated.

The boom 12 is raised and lowered by the boom supporting winch 24 which is connected to the multiple sheave unit 50 (FIGS. 1 and 6), another multiple sheave unit 58, and a sheave 60 by a wire rope 62 trained over said sheaves as clearly shown in FIGS. 1 and 6. The sheaves 50,58 and 60 along with a portion of the wire rope 62 define a multiple sheaved boom hoist 68.

Conventional controls (not shown) are provided to enable the operator to selectively operate the cylinders 38,40 (FIG. 5) to extend and retract the boom sections, and to operate the boom supporting winch 24 to pivotally raise and lower the mast 44 and the boom 12. Also, it will be apparent that the boom 12 and the upper works 20 may be pivoted 360° about axis A (FIG. 1), and that the boom may be lowered into transport position against the boom rest 64 as illustrated in FIG. 2.

As previously mentioned, when the boom supporting winch 24 is held stationary, extension of the boom (which is supported only by pendant lines external of the boom) will tend to cause the tip of the boom to raise during extension. When the boom is retracted, the tip of the boom will tend to drop.

As best shown in FIGS. 3–6, the pendant pay-out system 10 includes a multiple sheaved pendant take-up hoist 70. The take-up hoist includes a multiple floating sheave assembly 72 that includes a plurality of sheaves 73 and rollers 74 journaled on a shaft 76 which is secured to the outer end of the tip section 34 by a pair of fixed length pendant lines or wire ropes 80. A portion of the boom hoist wire rope 62 is trained around the floating sheaves 73, around sheaves 73*a* (shown slightly smaller than sheaves 50 for illustrative purposes) and around the multiple sheave unit 50 thereby defining the pendant take-up hoist 70. The free end of the rope 62 is anchored to the mast 44 as shown in FIGS. 3 and 4.

It will be understood that the term "multiple sheaved" as used in the specification and claims is intended to cover a single sheave with a plurality of grooves or a plurality of single groove sheaves.

The rollers 74 are of slightly larger diameter than the diameter of the floating sheave 73 so that they will contact and roll on the boom when moving into and out of the transport position as shown in FIGS. 2 and 4. When in the transport position of FIG. 2, it will be noted that rope 62 is taut and abutting a cross-bar 81 secured to the mast 44.

As illustrated in FIG. 6, the boom hoist 68 has fifteen runs or parts of boom hoist rope 62 while the pendant take-up hoist has eight runs or parts of rope 62. Thus, the ratio of the two hoists as illustrated is 15 to 8. Also it will be apparent that the mechanical advantage of the hoists as illustrated is 15 to 1 for the boom hoist 68 and 8 to 1 for the pendant take-up hoist 70.

A floating sheave stop 82 (FIGS. 3, 4 and 6) includes a pair of arms 84 secured to the shaft 52 at the upper end of the mast 44. The outer end of the arms 84 are provided with notches or recesses 86 (FIGS. 3 and 4) which cradle the end portions of the shaft 76 of the floating sheave 72. The stop 82 is pivotally supported by the mast 44, but is limited in its downward pivotal movement by contact between the arms 84 and blocks 88 that are rigidly secured to the mast.

In operation, starting with the boom 12 fully retracted and both the boom and mast 44 in their lowered transport position of FIG. 2, the operator actuates conventional controls to drive the boom supporting and pendant take-up winch 24 in a direction which hauls in rope 62. At this time, the shaft 76 of the floating sheave assembly 72 is in firm engagement with the recesses 86 of stop arms 84. Accordingly, the mast 44 begins to raise relative to the boom 12. Initial raising of the mast causes the roller 74 of the floating sheave 72 to roll along the upper surface of the boom and to pivot downwardly from the position illustrated in FIG. 4 until the stop arms 84 are prevented from further downward movement by the blocks 88. When the mast 44 reaches the predetermined mast-boom angle determined by the length of fixed pendants 48, the slack in fixed length pendants 48 and 80 as illustrated in FIG. 2 will be completely removed and the shaft 76 of floating sheave assembly 72 will be slightly spaced from the stop arms 84 (FIG. 3). Thus, further rotation of winch 24 will raise the boom 12 from the transport position to a raised working position such as that shown in FIGS. 1 and 3, which Figures also illustrate the upper works pivoted 180° about vertical axis A relative to FIG. 2.

In order to establish the predetermined mast boom angle and to raise the boom when the boom sections are fully retracted, it will be apparent that the fixed length pendants 80 are first fully tensioned by the weight of the boom and then pulls the shaft of the floating sheave assembly 72 away from the stop arms 84 before tensioning the fixed length pendants 48. When extending the boom 12 by means of the hydraulic cylinders 38 and 40 (FIG. 5) the operator also operates the winch 24 to pay out wire rope 68 so as to maintain the pendant lines 48 taut. This causes the floating sheave assembly 72 of the pendant take-up hoist 70 to move outwardly while the operator visually maintains the same boom angle and mast-boom angle.

When it is desired to retract the boom and retain the boom angle and boom-mast angle constant, the operator retracts the cylinders 38 and/or 40 and simultaneously actuates the winch to take-up wire rope thus maintaining the boom angle constant.

When the boom 12 is fully retracted but elevated in a working position as illustrated in FIGS. 1 and 3, the shaft 76 of the floating sheave assembly 72 is adjacent or may be cradled within, the recesses 86 of the stop arms 84 as illustrated. Controlling the winch 24 to pay out wire rope 62, first lowers the boom 12 into its transport position of FIG. 2. Continued paying out of rope 62 will release tension on the fixed length pendant 48 thereby pulling shaft 76 of the floating sheave assembly 72 into abutting contact with the stop arm recesses 86. Thus, the winch 24 maintains complete control of the mast 44 as it is being lowered.

Further paying out or releasing rope from the winch 24 allows the weight of the mast 44 and pendant take-up winch 70 to retain the stop arms 84 against the abutments 88 thereby continuing to pivot the mast downwardly. When the roller 74 of the floating sheave assembly contacts the upper surface of the base section 30 of the boom 12 and rolls therealong, the arms 84 move away from the abutments 88 and into position substantially parallel to the mast 44 as shown in FIGS. 2 and 4 with both fixed length pendants 48,80 being slack at this time. Accordingly, it is apparent that the pivoted stop provides means for reducing the overall height of the crane 14 when in its transport position. The winch 24 is stopped by the operator, and maintained in a fixed position by spring set brakes, which brakes provides a suitable amount of tension on the rope 62 thus maintaining the rope 62 tightly reaved around the associated sheaves.

From the foregoing description it is apparent that the pendant pay-out system and method of the present invention uses a single wire rope trained around a boom hoist and a pendant take-up winch which includes a floating sheave assembly to pivotally raise or lower the mast between a transport position and a plurality of elevated working positions. A first fixed pendant connected between the live mast and the base section of the boom determines the mast-boom working angle; and a second fixed length pendant connected between an extensible boom section and the floating sheave assembly cooperates with the hoist to support the extensible boom portion when in working position and either partially or fully extended. A stop mechanism cooperates with the floating sheave assembly to maintain complete control of the mast when being lowered relative to the boom, and for preventing the boom from raising prior to the mast reaching its desired working angle.

Although the best mode contemplated for carrying out the present invention has been herein shown and described, it will be apparent that modification and variation may be made without departing from what is regarded to be the subject matter of the invention.

What is claimed is:

1. A method of controlling the working angles of a pivotally supported extensible boom and the mast-boom angle between a lowered transport position and a predetermined raised mast-boom working angle; said boom including a base section and an extensible section movable along a longitudinal axis, a first fixed length pendant between the mast and a non-extensible portion of the boom to establish said mast-boom working angle; said angles being changed by movement of a rope trained around a winch, a boom supporting hoist, and a pendant take-up hoist that includes a multi-groove floating sheave assembly; a second fixed length pendant connected between the telescopic boom section and the floating sheave assembly; and a floating sheave stop means pivotally connected to said mast; when said boom is fully retracted and said mast and boom are in their transport positions, said method comprising the steps of maintaining a portion of said floating sheave assembly cradled within and in firm abutting contact with a recess in the sheave stop, raising the mast to pull said second fixed length pendant taut and to pay out sufficient rope from the pendant take-up winch for establishing said boom angle by pulling said first pendant taut and moving said portion of said floating sheave out of abutting contact with said stop thereby maintaining complete control of said mast during movement from its transport position to its working position.

2. A method according to claim 1 and additionally comprising the step of pivoting the stop and the floating sheave assembly from a transport position in approximate alignment to a position substantially normal to the mast in response to movement of the mast from its transport position to its working position.

3. A method according to claim 2 and additionally comprising the step of rolling the floating sheave assembly along the upper surface of the boom when being raised into working position.

4. A method according to claim 1 wherein said method additionally comprising the steps of: maintaining a portion of the floating sheave assembly within said recess while being raised, removing all slack from the second pendant and paying out a small amount of rope from the pendant take-up winch until the first fixed length pendant is pulled taut for establishing the mast-boom angle, and continuing actuation of the boom hoist to pivotally raise the boom to a working angle while retaining the mast-boom angle constant.

5. A method according to claim 4 and additionally comprising the steps of pivoting the stop between a position in substantial alignment with the longitudinal axis of the mast and a position substantially normal to the mast when pivoting the mast between its transport position and its working position.

6. A method according to claim 4 and additionally comprising the step of extending the boom at a selected rate while actuating the winch at a rate to pay-out rope from the pendant take-up hoist and retaining said boom angle constant.

7. A method according to claim 6 wherein said winch is actuated at a rate faster than the rate which maintains the boom angle constant thereby additionally causing rope to pay-out of the boom winch causing said boom angle to decrease and said mast-boom angle to remain constant.

8. A method according to claim 6 wherein said winch is actuated at a rate slower than the rate which maintains the boom angle constant causing said boom angle to increase and said mast-boom angle to remain constant.

* * * * *